United States Patent [19]

Nakajima et al.

[11] 4,150,536

[45] Apr. 24, 1979

[54] ELECTRONIC TIMEPIECE

[75] Inventors: Fumio Nakajima, Tokyo; Kenji Yamada, Koganei; Takayasu Machida, Iruma; Yasushi Nomura; Minoru Watanabe, both of Tokorozawa, all of Japan

[73] Assignee: Citizen Watch Company Limited, Tokyo, Japan

[21] Appl. No.: 760,890

[22] Filed: Jan. 21, 1977

[30] Foreign Application Priority Data

Jan. 28, 1976 [JP] Japan ..... 51-8097
Apr. 2, 1976 [JP] Japan ..... 51-36883

[51] Int. Cl.[2] ..... G04C 9/00

[52] U.S. Cl. ..... 58/23 D; 58/23 BA; 58/34; 58/85.5

[58] Field of Search ..... 58/23 R, 23 D, 85.5, 58/23 BA, 34

[56] References Cited

U.S. PATENT DOCUMENTS

| | | | |
|---|---|---|---|
| 3,690,058 | 8/1972 | Kurita | 58/23 R |
| 3,754,391 | 8/1973 | Fujita | 58/23 R |
| 3,786,625 | 1/1974 | Sauthier | 58/23 R |
| 3,792,577 | 2/1974 | Fujita | 58/23 R |
| 3,810,354 | 5/1974 | Naikaido et al. | 58/23 D |
| 3,810,355 | 5/1974 | Ito | 58/88.5 X |
| 3,852,951 | 12/1974 | Sauthier | 58/23 R |
| 3,895,486 | 7/1975 | Hammer et al. | 58/23 R |
| 3,901,022 | 8/1975 | Cleusix et al. | 58/88.5 |
| 3,906,256 | 9/1975 | Suzuki et al. | 58/23 R X |
| 3,948,035 | 4/1976 | Kusumoto | 58/23 R |
| 3,948,036 | 4/1976 | Morokawa | 58/23 R |
| 3,998,044 | 12/1976 | Yamauchi | 58/23 R |

*Primary Examiner*—Stanley J. Witkowski
*Attorney, Agent, or Firm*—Frank J. Jordan

[57] ABSTRACT

An electronic timepiece includes a reversible stepping motor to drive rotatable hands to provide a time display. In a first preferred embodiment, the electronic timepiece includes a circuit means to generate alternating current pulses having an increased pulse width or an increased amplitude to drive the stepping motor with an increased driving current during high speed time correction when a manually operable external control member is actuated during time correction. In a second preferred embodiment, the electronic timepiece comprises a clockwise correction switch, a counter-clockwise correction switch and circuit means for generating first and second alternating current pulses of first and second pulse widths at a predetermined frequency higher than normal driving pulses to drive a stepping motor in clockwise and counter-clockwise directions, respectively, to perform clockwise and counter-clockwise corrections when the clockwise and counter-clockwise correction switches are actuated during time corrections, respectively. The pulse width of the second alternating current pulses is selected to be smaller than that of the normal driving pulses.

8 Claims, 17 Drawing Figures

ELECTRONIC TIMEPIECE

This invention relates to battery-powered electronic timepieces and, more particularly, to an electronic timepiece having a time-indicating mechanism driven by a stepping motor.

In general, a conventional electronic timepiece of the type having a time-indicating mechanism such as seconds, minutes and hours hands is driven by a stepping motor composed of a permanent magnet rotor, stators and a driving coil. The driving coil is applied with alternating polarity pulses of the same low frequency. The stepping motor is driven stepwise and directly geared to a wheel of the dial train drive, which drives the rotatable hands of the timepiece, the hands providing the time display.

In known electronic timepieces of the type mentioned above, it has heretofore been proposed to have the timepiece provided with a driver circuit arranged to generate 1 Hz driving pulses in a normal timekeeping mode and higher frequency correction pulses of, for example 32 Hz during a time correction. During the time correction, the stepping motor is driven at a speed higher than normal. In the prior art, the pulse width of the normal driving pulses is set to a value optimum for providing a stable operation for the normal timekeeping mode, and the pulse width of the correction pulses is made equal to that of the normal driving pulses with a view to simplifying the circuit arrangement of the timepiece. However, in cases where the correction pulses have a relatively high frequency, the stepping motor can not follow each of the correction pulses, resulting in an inaccurate advancement of the motor and inaccurate setting of the desired time. This problem can be solved by increasing the pulse width of the correction pulses. If, however, the pulse width of the normal driving pulses is selected to be equal to the increased pulse width of the correction pulses, the power consumption will be increased.

Another drawback is encountered with the conventional stepping motor employed in the electronic timepiece in that the magnetic poles of the two stators and the magnetic poles of the rotor define an angle (hereinafter referred to as the angle of static equilibrium ($\alpha$) which is approximately 45 degrees in magnitude; reverse rotation is therefore impossible. Although reverse rotation can be achieved by using normal driving pulses if the angle of static equilibrium is set approximately between 0 and 20 degrees a situation can arise in which the driving pulses are not followed during normal operation and an unwanted reversal can occur whenever there is a disagreement in the correspondence between the magnetic poles of the rotor and the phase of the driving pulses owing to replacement of the battery. In addition, efficiency is reduced during clockwise rotation which leads to an increase in power consumption. These are some defects encountered in conventional stepping motors.

It is, therefore, an object of the present invention to provide an electronic timepiece having an electric circuitry adapted to drive a stepping motor in accurate fashion during a normal timekeeping mode and a time correction mode of the timepiece.

It is another object of the present invention to provide an electronic timepiece arranged to provide an increased driving current to a stepping motor during time correction.

It is another object of the present invention to provide an electronic timepiece having rotatable hands driven by a stepping motor which is normally driven by normal driving pulses of a first pulse width and driven by high frequency correction pulses of a second pulse width to perform accurate advancement of the rotor.

It is another object of the present invention to provide an electronic timepiece having rotatable hands driven by a stepping motor which is adapted to be supplied with high frequency correction pulses of an amplitude greater than that of the normal driving pulses of low frequency.

It is a further object of the present invention to provide an electronic timepiece having a reversible stepping motor adapted to drive rotatable hands either in clockwise or in counter-clockwise direction.

It is a further object of the present invention to provide an electronic timepiece incorporating a reversible stepping motor, wherein the angle of static equilibrium defined by the magnetic poles of two stators and the magnetic poles of a rotor is an angle with a magnitude between 20 and 40 degrees, reverse rotation being made possible by driving pulses having a pulse width narrower than normal driving pulses which themselves do not induce reverse rotation.

It is a further object of the present invention to provide an electronic wristwatch incorporating a reversible stepping motor in which the hands of the electronic wristwatch can be rapidly corrected by rotating them in the clockwise or reverse direction during a time correction by means of high speed correction pulses having a pulse width narrower than that of the normal driving pulses.

It is a still further object of the present invention to provide an electronic wristwatch capable of being corrected for time differentials.

These and other objects, features and advantages of the present invention will become more apparent from the following description when taken in conjunction with the accompanying drawings, in which.

Figure 1:
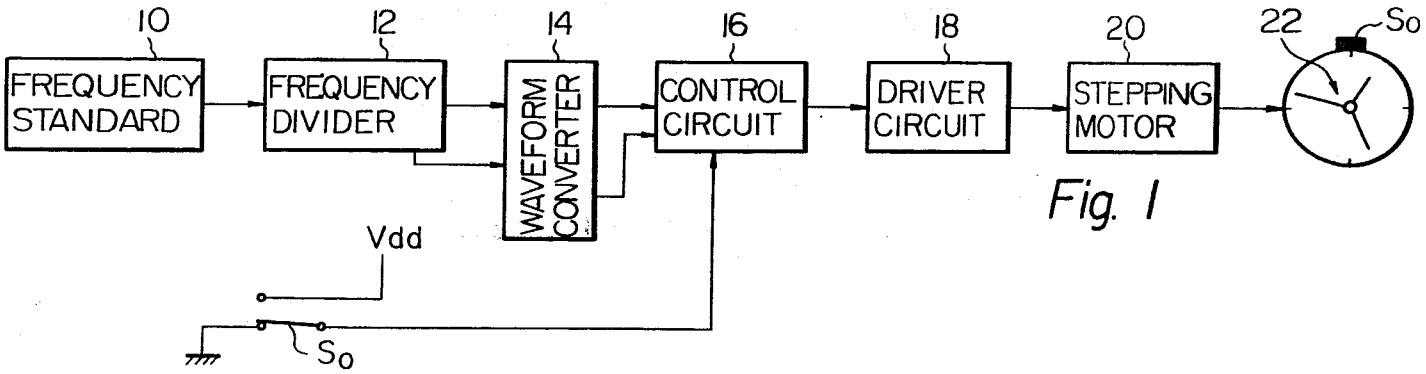
FIG. 1 is a block diagram of a preferred embodiment of an electronic timepiece according to the present invention.

Referring now to FIG. 1, there is shown a block diagram of a preferred embodiment of an electronic wristwatch embodying the present invention. The electronic wristwatch comprises a frequency standard 10 controlled by a quartz crystal (not shown) to provide a relatively high frequency signal of 32,768 Hz. This relatively high frequency signal is applied to a frequency divider 12, which divides down the relatively high frequency signal to provide first and second low frequency signals. These low frequency signals are applied to a waveform converter 14, which provides first and second output pulses in response to the first and second low frequency signals, respectively. These output pulses are applied to a control circuit 16, which is controlled by a manually operable external control member $S_o$. The external control member $S_o$ is normally held at a "0" logic level. Under this condition, the control circuit 16 passes the first output pulses from the waveform converter 14 to a driver circuit 18, by which alternating current pulses of 1 Hz are generated. The alternating current pulses are applied to a stepping motor 20, which is driven clockwise in a stepwise fashion and directly geared to a wheel of the dial train drive to actuate time-indicating hands 22 providing the time display. The power for the component parts of the electronic wristwatch is obtained from a small battery within the watch case. When the external control member $S_o$ is coupled to a positive terminal $V_{dd}$ of the battery, the control circuit 16 passes the second output pulses of 32 Hz to the driver circuit 18, which generates second alternating current pulses of 32 Hz. The stepping motor 20 is driven stepwise at a higher speed in response to the second alternating current pulses of 32 Hz to rapidly advance the rotatable hands 22 of the watch.

Figure 2:
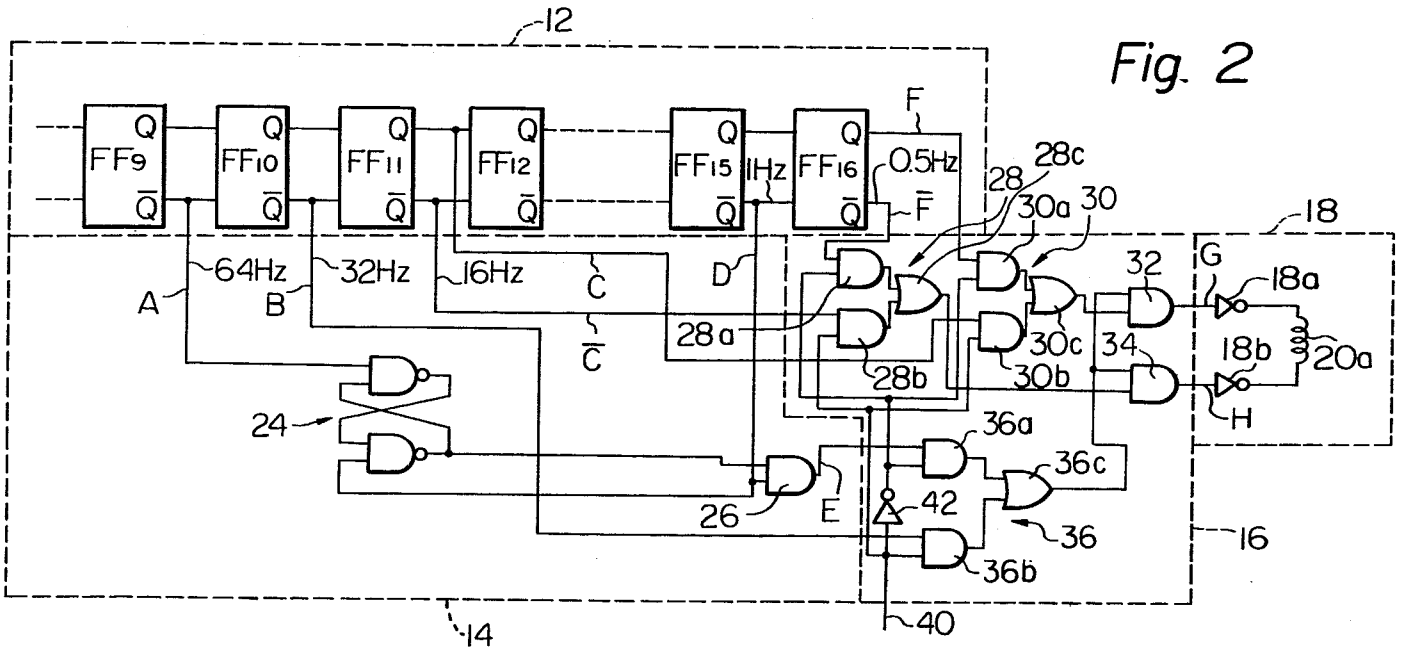
FIG. 2 is a detailed electric circuit arrangement for the electronic timepiece of FIG. 1.
Figure 3:
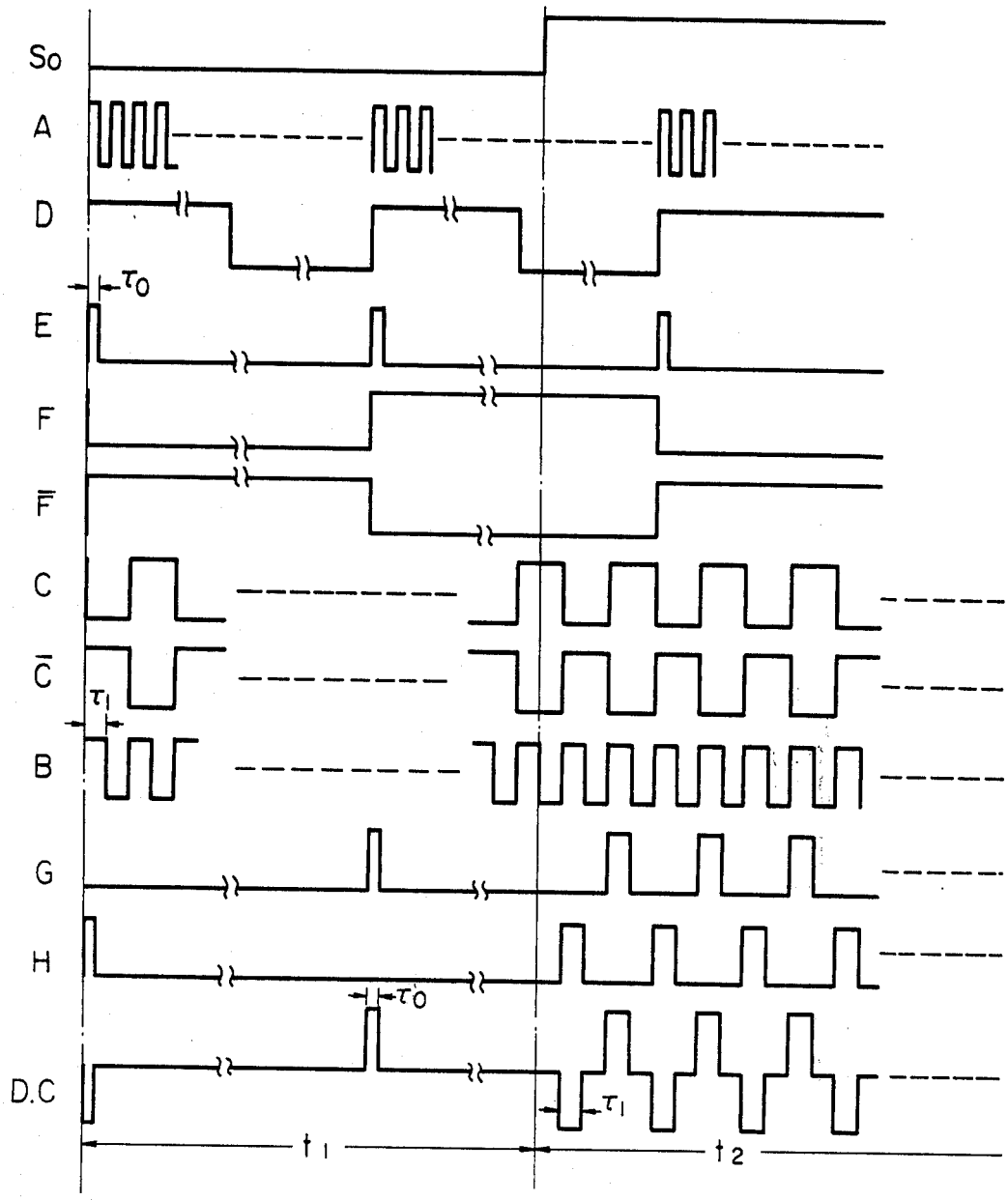
FIG. 3 is a timing chart for illustrating the operation of the circuit shown in FIG. 2.

FIG. 2 shows a detail circuitry for the essential parts of the electronic wristwatch shown in FIG. 1. In FIG. 2, the frequency divider 12 is seen to have sixteen flip-flops FF1 to FF16, of which only flip-flops FF9 to FF12, FF15 and FF16 are shown in the drawing. The flip-flop 9 generates at its $\overline{Q}$ output an output signal A of 64 Hz as shown in FIG. 3. The output signal A is applied to one input of a flip-flop 24 to another input of which is applied an output signal D of 1 Hz generated by the flip-flop FF15. An output of the flip-flop 24 is applied to one input of an AND gate 26, to another input of which is applied the output signal D from the flip-flop FF15. The AND gate 26 serves as a means for generating first output pulses E of a first pulse width $\tau_o$ at 1 Hz. The pulse width $\tau_o$ is selected to have a value optimum for providing a driving current to drive the stepping motor in the most stable fashion in its normal operating mode, i.e., in a normal timekeeping mode of the watch. In this preferred embodiment, the pulse width $\tau_o$ has a value of 1/128 seconds.

As shown in FIG. 2, the control circuit 16 comprises first and second gate circuits 28 and 30, whose outputs are coupled to inputs of AND gates 34 and 32, respectively. The first gate circuit 28 is composed of a first AND gate 28*a* responsive to the output signal $\overline{F}$ from the flip-flop FF16, a second AND gate 28*b* responsive to the output signal $\overline{C}$ from the flip-flop FF11, and an OR gate 28*c* having its inputs coupled to outputs of the first and second AND gates 28*a* and 28*b*. Similarly, the second gate circuit 30 is composed of a first AND gate 30*a* responsive to the output signal F from the flip-flop FF16, a second AND gate 30*b* responsive to the output signal C of the flip-flop FF11, and an OR gate 30*c* having its inputs coupled to outputs of the first and second AND gates 30*a* and 30*b*.

The control circuit 16 also comprises a third gate circuit 36 adapted to selectively pass second output pulses B of a pulse width $\tau_1$ at 32 Hz and the first output pulses E of the pulse width $\tau_o$ at 1 Hz to the remaining inputs of the AND gates 32 and 34 in dependence on the state of the external control member $S_o$. More specifically, the third gate circuit 36 is composed of a first AND gate 36*a* having its one input connected to the output of the AND gate 26, a second AND gate 36*b* having its one input connected to the $\overline{Q}$ output of the flip-flop FF10, and an OR gate 36*c* having its inputs coupled to outputs of the first and second AND gates 36*a* and 36*b*. The output of the OR gate 36*c* is coupled to the remaining inputs of the AND gates 32 and 34. The remaining inputs of the AND gates 28*a*, 30*a* and 36*a* are connected through an inverter 42 to a lead 40 coupled to the external control member $S_o$, to which the remaining inputs of the AND gates 28*a*, 30*b* and 36*b* are directly connected.

In a normal timekeeping mode of the watch, the lead 40 connected to the external control member 40 is maintained at a "0" logic level. Under this condition, the AND gates 28*b*, 30*b* and 36*b* are inhibited, whereas the AND gates 28*a*, 30*a* and 36*a* are opened. Consequently, the output signals F and $\overline{F}$ of 0.5 Hz are gated through the AND gates 30*a* and 28*a* and applied through the OR gates 30*c* and 28*c* to one inputs of the AND gates 32 and 34, respectively. Therefore, the AND gates 32 and 34 are alternatively opened in response to the output signal F and $\overline{F}$. Since, in this instance, the first output pulses E generated by the AND gate 26 is passed through the AND gate 36*a* and the OR gate 36*c* to the remaining inputs of the AND gate 32 and 34, the AND gates 32 and 34 generate output signals G and H having the waveforms as shown in FIG. 3 during the time interval $t_1$. Thus, the driver circuit 18 composed of inverters 18*a* and 18*b* generates first alternating current pulses D.C. of the pulse width $\tau_o$ at 1 Hz, by which a driving coil 20*a* of the stepping motor 20 is energized. In this case, the stepping motor 20 is driven stepwise to drive the time-indicating means 22 in a normal mode.

When the external control member $S_o$ is coupled to the positive power supply terminal $V_{dd}$ of the battery for the time interval $t_2$ as shown in FIG. 3, the AND gates 28*a*, 30*a* and 36*a* are inhibited, whereas the AND gates 28*b*, 30*b* and 36*b* are opened. Under these circumstances, the output signals C and $\overline{C}$ from the flip-flop FF11 are gated through the AND gate 30*b* and the OR gate 30*b*, and the AND gate 28*b* and the OR gate 28*c* to the AND gate 32 and 34, respectively. At the same time, the output pulses B of 32 Hz from the flip-flop FF10 are applied through the AND gate 36*b* and OR gate 36*c* to the AND gates 32 and 34. Consequently, the AND gates 32 and 34 generate output pulses G and H of the pulse width $\tau_1$ as shown in FIG. 3, and the driver circuit 18 generates second alternating current pulses D.C. of the pulse width $\tau_1$ at 32 Hz so that the stepping motor 20 is driven at high speed to rapidly advance the rotable hands 22.

It should be noted that during a high speed advancing mode of the stepping motor the second alternating current pulses D.C. have the pulse width $\tau_1$ greater than the pulse width $\tau_o$ of the first driving pulses and, therefore, the second alternating current pulses can be reliably followed by the stepping motor even when the second alternating current pulses have a higher frequency whereby it is possible to perform an accurate time correction.

Figure 4:
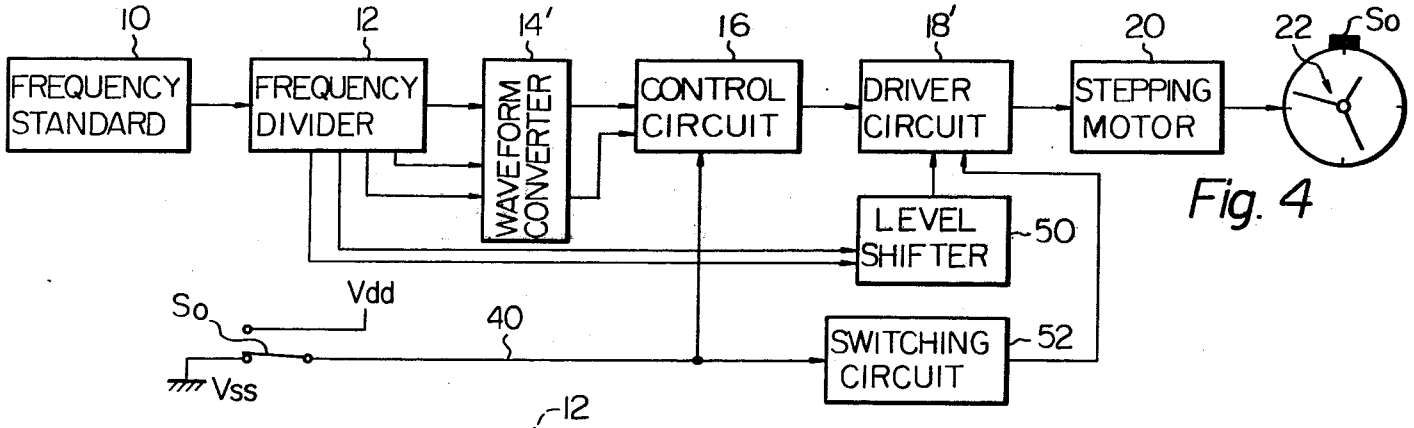
FIG. 4 is a block diagram of a modification of the timepiece shown in FIG. 1.

FIG. 4 shows a block diagram of a modified form of the electronic timepiece shown in FIG. 1, with like parts bearing like reference numerals as those used in FIG. 1 except that a single prime (') has been added to those which indicate modified elements. In FIG. 4, a waveform converter 14' generates first output pulses of 1 Hz and second output pulses of 32 Hz having the pulse width equal to that of the first output pulses. The first and second output pulses are applied to a control circuit 16, which selectively provides first and second output pulses to a driver circuit 18'. The driver circuit 18' generates first and second alternating current pulses in response to the first and second output pulses from the control circuit 16. When the external control member $S_o$ is coupled to the high potential side $V_{dd}$ of the battery, the control circuit 16 generates second output pulses in response to the second output pulses from the waveform converter 14'. At the same time, a switching circuit 52 is actuated to couple a level shifter 50 to the driver circuit 18'. At this instant, the driver circuit 18' is applied with increased voltage, thereby generating second alternating current pulses of 32 Hz and having an amplitude greater than the first driving pulses to increase the magnitude of electric current applied to the driving coil of the stepping motor 20 to prevent miscounting or inaccurate advancing of the stepping motor.

Figure 5:
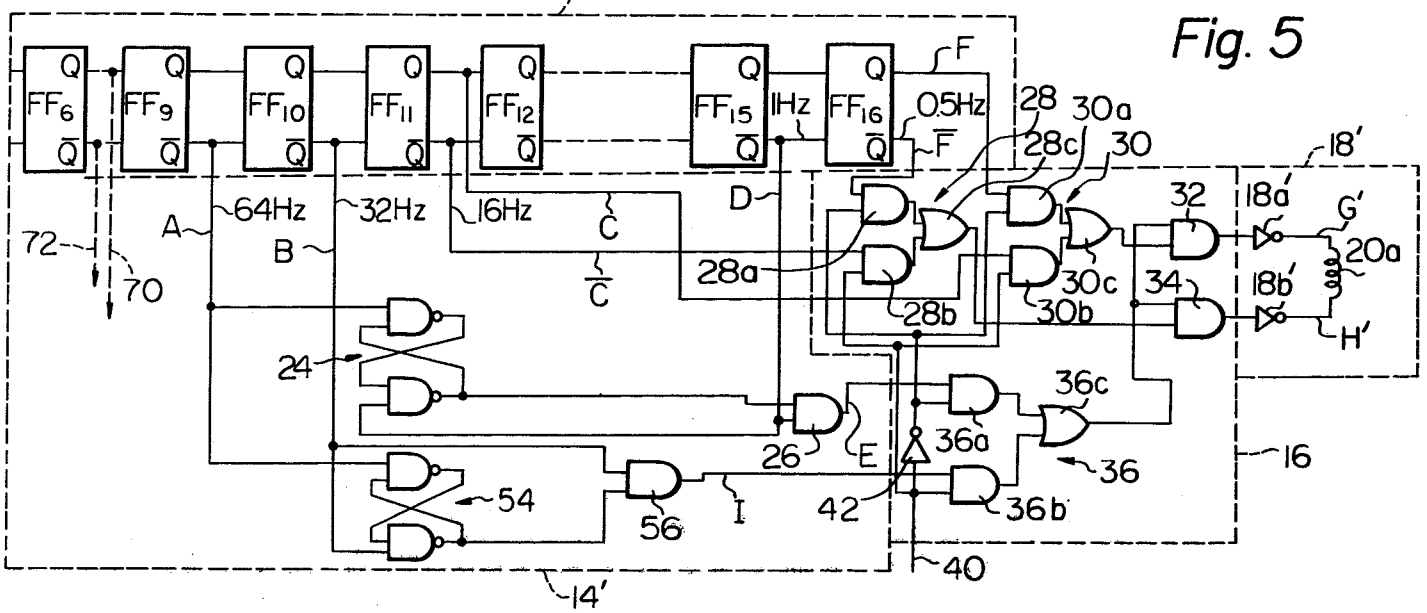
FIG. 5 is a detailed circuit arrangement of a part of the timepiece shown in FIG. 4.
Figure 6:
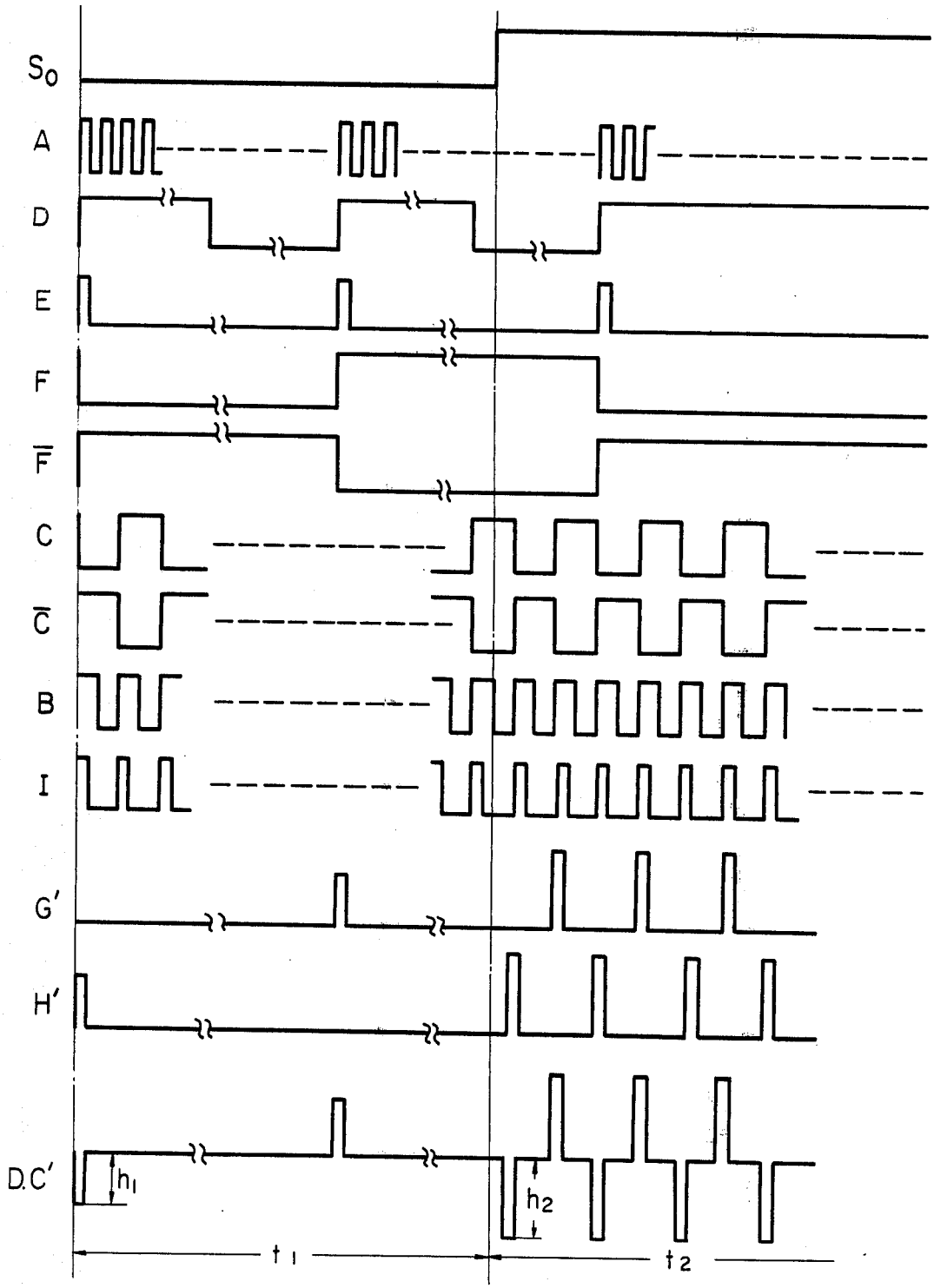
FIG. 6 is a timing chart for illustrating the operation of the timepiece shown in FIG. 4.

FIG. 5 shows a preferred example of the waveform converter 14'. The waveform converter 14' is identical to that shown in FIG. 2 except that a flip-flop 54 and an AND gate 56 are additionally provided and the one input of the AND gate 36b is connected to an output of the AND gate 56 instead of the $\overline{Q}$ output of the flip-flop FF10. More specifically, the flip-flop 54 has its first input coupled to the $\overline{Q}$ output of the flip-flop FF9 of the frequency divider 12 and its second input coupled to the $\overline{Q}$ output of the flip-flop FF10. An output of the flip-flop 54 is coupled to one input of the AND gate 56, whose other input is coupled to the $\overline{Q}$ output of the flip-flop FF10 to generate output pulses I as shown in FIG. 6.

Figure 7:
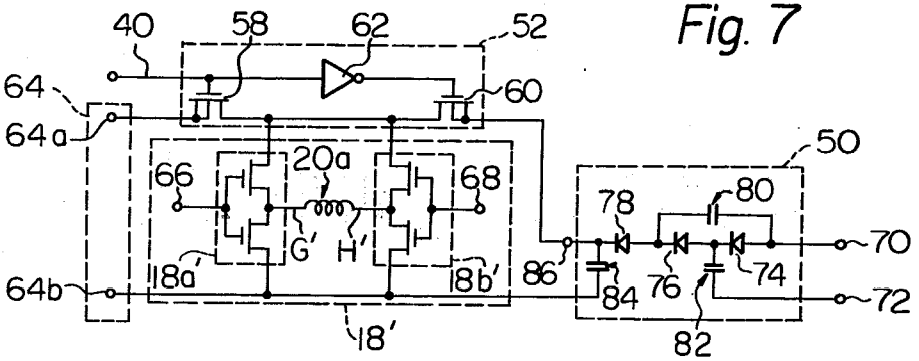
FIG. 7 is a detailed circuit arrangement of another part of the timepiece shown in FIG. 4.

FIG. 7 shows a detailed circuit arrangement for the switching circuit 52, the level shifter 50, and the driver circuit 18'. In FIG. 7, the switching circuit 52 comprises first and second metal oxide semiconductor field effect transistors (MOSFETs) 58 and 60, and an inverter 62. The gate terminal of the MOSFET 58 is coupled through the lead 40 to the external control member $S_o$, to which the gate terminal of the MOSFET 60 is coupled through the inverter 62.

The driver circuit 18' comprises first and second inverters 18'a and 18'b, each composed of a complementary pair of MOSFETs. Inputs of the inverters 18'a and 18'b are connected in parallel with a positive power supply terminal 64a of a battery 64 through the first MOSFET 58 serving as a first switching element. The other inputs of the inverters 18'a and 18'b are also connected in parallel to a negative power supply terminal 64b of the battery 64. Control gates 66 and 68 of the inverters 18'a and 18'b are coupled to the outputs of the AND gates 32 and 34 of the control circuit 16 to receive the output pulses G' and F' therefrom. Outputs of the inverters 18'a and 18'b are connected to both ends of the driving coil 20a of the stepping motor 20.

The level shifter 50 comprises first and second charging terminals 70 and 72 coupled to the Q output and Q output of the flip-flop FF6 of the frequency divider 12 (see FIG. 5), first, second and third diodes 74, 76 and 78 connected in series with the first charging terminal 70, a first capacitor 80 connected across the first and second diodes 74 and 76, a second capacitor 82 connected between the second charging terminal 72 and an output of the diode 74, and a third capacitor 84 connected between the negative power supply terminal 64b of the battery 64 and the output of the third diode 78. An output 86 of the level shifter 50 is connected to the inputs of the inverters 18'a and 18'b of the driver circuit 18' through the second MOSFET 60 serving as a second switching element of the switching circuit 52.

In a normal timekeeping mode of the timepiece, the external control member $S_o$ is connected to the negative side of the battery so that the lead 40 is at a "0" logic level. Under this condition, the first switching element 58 is conductive while the second switching element 60 is nonconductive. Therefore, the first inputs of the inverters 18'a and 18'b are coupled to the positive power supply terminal 64a of the battery 64. Under these circumstances, the inverters 18'a, and 18'b apply to the driving coil 20a first alternating driving current pulses of the amplitude $h_1$ during the time interval $t_1$ as shown in FIG. 6.

When the external control member $S_o$ is connected to the positive power supply terminal $V_{dd}$ of the battery and the lead 40 goes to a "1" logic level, the switching element 58 is nonconductive while the switching element 60 is conductive. In this case, the inputs of the inverters 18'a and 18'b are coupled to the output 86 of the level shifter 50. In this instance, since the charging terminals 70 and 72 are applied with high frequency signal from the flip-flop FF7 of the frequency divider 12, the first capacitor 80 is charged when the first charging terminal 70 goes to a high logic level, and the second capacitor 82 is charged when the second charging terminal 72 goes to a high logic level. Therefore, the voltage level at the output 86 of the level shifter 50 will be about twice that of the supply voltage of the battery 64. This increased voltage is applied to inputs of the inverters 18'a and 18'b of the driver circuit 18', which consequently generates second driving current pulses having the amplitude $h_2$ approximately twice the amplitude $h_1$ during the time interval $t_2$ as shown in FIG. 6. Thus, the stepping motor 20 is driven with increased driving current during time correction or seconds zeroing, which will be accurately performed.

Figure 8:
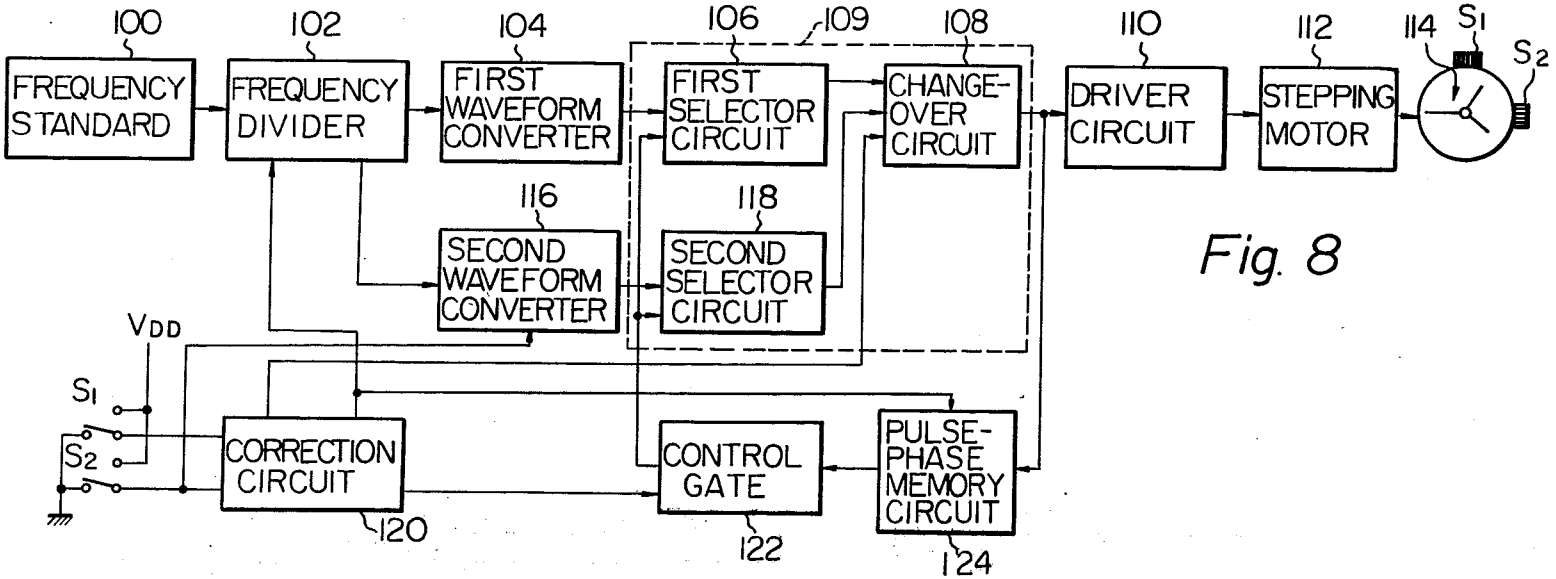
FIG. 8 is a block diagram of another preferred embodiment of an electronic timepiece according to the present invention.

FIG. 8 is a block diagram of another preferred embodiment of the electronic wristwatch according to the present invention. In this preferred embodiment, the electronic wristwatch comprises a frequency standard 100 controlled by a quartz crystal (not shown) to provide a relatively high frequency signal. This relatively high frequency signal is applied to a frequency divider 102 which divides down the relatively high frequency signal to provide first low frequency signals. The first low frequency signals are applied to a first waveform converter 104, which provides first low frequency two-phase pulses of a first pulse width. These pulses are applied through a first selector circuit 106 and a change-over circuit 108 of a control circuit 109 to a driver circuit 110. The driver circuit 110 generates low frequency alternating current pulses, which are applied to a stepping motor 112 connected through a dial train (not shown) to a time-indicating mechanism 114 to display time.

The electronic timepiece further comprises a second waveform converter 116, to which second low frequency signals are applied from the frequency divider 102. The second low frequency signals are higher in frequency than the first low frequency signals. During a clockwise correction mode, the second waveform converter 116 generates second low frequency two-phase pulses of a second pulse width which are applied through a second selector circuit 118 of the control circuit 109 to the change-over circuit 108, through which the second low frequency two-phase pulses are passed to the driver circuit 110. In this case, the driver circuit 110 generates higher frequency alternating current pulses by which the stepping motor 112 is advanced at a high speed, to perform time correction.

A correction circuit 120 is connected to first and second manually operable external control member $S_1$ and $S_2$, which serve as a clockwise correction switch and a counter-clockwise correction switch, respectively. The correction circuit 120 generates a switching signal to actuate the change-over circuit 108 and a reset pulse to reset the frequency divider 102 to zero when the clockwise correction switch $S_1$ is depressed. When the counter-clockwise correction switch $S_2$ is depressed, the second waveform counter 116 generates third low frequency two-phase pulses of a third pulse width, and the correction circuit 120 generates an output pulse, which is applied to a control gate 122. The output pulses from the change-over circuit 108 are fed back to a pulse-phase memory circuit 124, to which the reset pulse from the correction circuit 120 is also applied. The pulse-phase memory circuit 124 generates first and second outputs in dependence on the phases of the output pulses delivered from the change-over circuit 108 and stored in the memory circuit 124. One of the first and second outputs is passed as a control signal through the control gate 122 to the first and second selector circuits 106 and 118. Each of the selector circuits 106 and 118 is responsive to the control signal to selectively pass one of the two-phase pulses to the change-over circuit 108.

Figure 9:
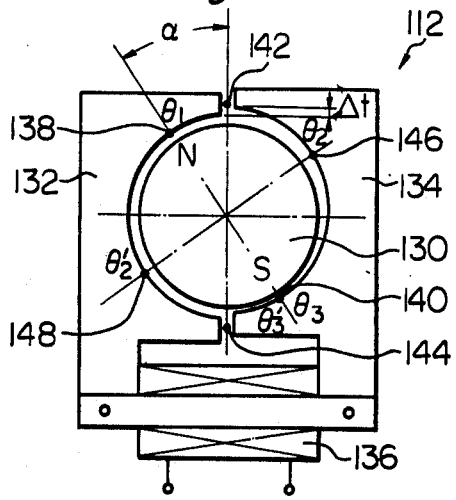
FIG. 9 is a schematic view of one example of a reversible stepping motor to be incorporated in the electronic timepiece shown in FIG. 8.

FIG. 9 shows one preferred example of the reversible stepping motor 112 shown in FIG. 8. In FIG. 9, reference numeral 130 denotes a rotor, 132 and 134 stators, and 136 a driving coil. The two stators are so disposed such that a difference in level $\Delta t$ establishes points of static equilibrium 138 and 140.

Figure 10:
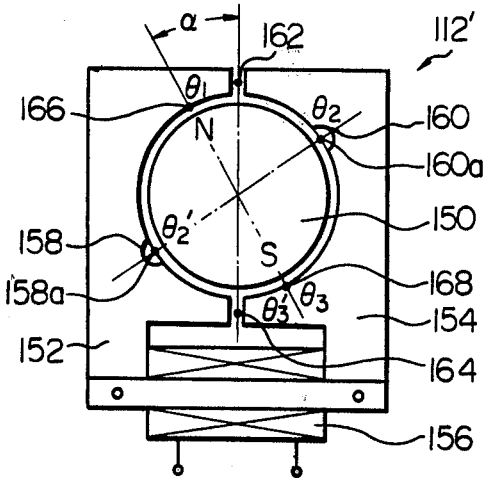
FIG. 10 is similar to FIG. 9 but shows another example of the reversible stepping motor.

In FIG. 10, which is another preferred example of the reversible stepping motor 112', reference numeral 150 denotes a rotor, 152 and 154 stators, and 156 a driving coil. Here, the stators are provided with indentations 158 and 160 in order to establish an angle of static equilibrium $\alpha$ which is set between 20 and 40 degrees.

Figure 11A:
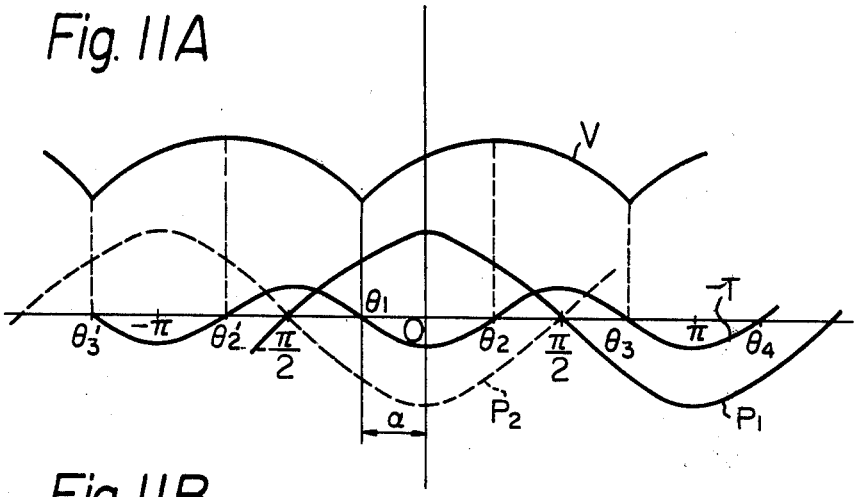
FIG. 11A is a graph showing the relationship between torque and angle of rotation of a rotor forming part of the stepping motor shown in FIG. 10.
Figure 11B:
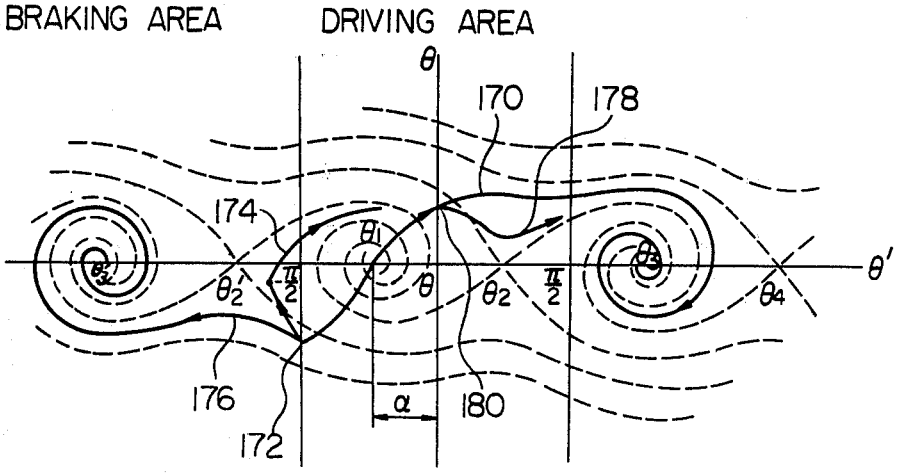
FIG. 11B is a view showing the trajectory face of rotation of the rotor.

FIG. 11A is a graph showing the relation between torque and angle of rotation, wherein $P_1$ is a curve representing driving force for clockwise rotation, $P_2$ a curve representing driving force for counter-clockwise rotation, T a curve representing the retentiveness resulting from the attractive force between the rotor and stators, and V is a curve representing potential energy. FIG. 11B is a view showing the trajectory face of rotation of the rotor forming part of the stepping motor.

In general, the equation for the motion of a stepping motor using a permanent magnet rotor is given by:

$$J\ddot{\theta}+\mu\dot{\theta}=A(\theta)I(t)-ToSin2(\theta+\alpha)-\rho(\theta) \ldots (1).$$

Wherein,

J: moment of inertia of the rotor $\mu$: coefficient of fluidic resistance $A(\theta)$: coefficient of electro-mechanical coupling $ToSin2(\theta+\alpha)=T$: retentiveness resulting from the mutual attractive force between the stators and the permanent magnet of the rotor I(t): driving current $\alpha$: angle of static equilibrium $\rho(\theta)$: load torque $A(\theta)\cdot I(t)=P$: driving torque In FIG. 11A, letting |H1 represent the magnetic field produced at the stator by the magnetic pole of the rotor, and letting 1 M represent the magnetic moment of the rotor, the potential energy of the rotor is given by—(|H1·|M). The rotor becomes stable when the potential energy attains a minimum value. At this time, however, the retentiveness T is equal to zero such that a point 166 ($\theta 1$) and a point 168 ($\theta 3$, $\theta 3'$) in FIG. 10 attain points of static equilibrium. Furthermore, it is also possible to express the driving torque as the vector product (|H2-×|M) of the magnetic field 1H2 arising from the driving current I(t) and the magnetic moment 1 M of the rotor. Since it is possible to attain such a relation as a function of $\theta$, $\theta=(\pi/2)$, and $\theta=-(\pi/2)$ are chosen as the limits and there is a reversal of sign. Accordingly, $$\frac{-\pi}{2} \leqq \theta \leqq \frac{\pi}{2}$$

defines the driving area and a braking area exists for $\theta>\pi/2$, and $\theta<-(\pi/2)$, as can be appreciated from FIG. 11B.

To determine the operational state of the motor after the driving pulse cuts off, the loading torque and the counter electromotive potential arising at the driving coil are omitted and it is assumed that thus $A(\theta)=0$, and $\rho(\theta)=0$. By so doing, equation (1) is transformed into $$J\ddot{\theta}+\mu\dot{\theta}+ToSin2(\theta+\alpha)=0 \ldots (2).$$

If $\tau=\sqrt{J/To}$, this equation can be converted and expanded into $$\ddot{\theta}+\frac{\mu}{\sqrt{J\,To}}\dot{\theta}+\sin 2(\theta+\alpha)=0 \qquad (3).$$

A plan view of the state described by equation (3) is illustrated by FIG. 11B in which $\theta 1$, $\theta 3$ and $\theta 3'$ are equilibrium spiral points and $\theta 2$, $\theta 4$ and $\theta 2'$ are nodes of unstable equilibrium. Now, if a driving pulse is applied to the driving coil 156 in FIG. 10, the stator 154 is excited to South magnetic polarity and stator 152 to North magnetic polarity whereby the rotor 150 rotates in the clockwise direction. This is represented by the path 170 in FIG. 11B. If in this case the rotor has a clockwise angular velocity at the point $\theta 2$ where the potential energy is maximum a node of unstable equilibrium, the rotor is capable of rotating and moving to the next equilibrium point $\theta 3$. If the moment of inertia of the rotor is less than $4\times10^{-12}$Kg-m$^2$, the rotor will arrive at the boundary between the driving area and braking area within 10 milliseconds due to such a driving pulse since the rotor is capable of rotating through an angle greater than $\alpha+(\pi/2)$. Therefore, for a driving pulse with a pulse width in excess of 10 milliseconds, the latter half of the pulse sends the rotor into the braking area. However, since the point at which the retentiveness and driving force are equal is greater than at $\theta 2$, the rotor will not return to the former equilibrium point $\theta 1$ during clockwise rotation even for long pulse widths.

For reverse rotation in the counter-clockwise direction, reference will again be had to FIG. 10. When a driving pulse is applied and the stator 154 excited to North polarity and the stator 152 to South polarity, the rotor begins to rotate under a rotational force acting in the reverse direction. Since the rotor reaches a point 172 within 7 milliseconds after rotating through an angle greater than $\pi/2-\alpha$, for a 10 millisecond driving pulse the latter half of the pulse sends the rotor into the braking domain whereby a curve 174 is described; thus, as can be appreciated from FIG. 11B, the rotor returns to the original equilibrium point $\theta 1$. If the angle of static equilibrium $\alpha$ is less than 20 degrees the rotor will have a considerable angular velocity by the time it reaches the point 172 and thus is capable of overcoming the braking effect and reaching the next equilibrium point $\theta 3'$. However, as long as $\alpha$ is between 20 and 40 degrees the rotor does not possess sufficient angular velocity at the point 172 and as a result the rotor is subjected to braking action during the latter half of a normal driving pulse thereby making it impossible to achieve reverse rotation. Accordingly, if the driving coil is supplied with a driving pulse having a pulse width shorter than the normal pulse width, for example, a pulse width of 7 milliseconds or less, the driving pulse cuts off immediately before the rotor enters the braking domain such that the rotor describes the curve denoted by 176 and reaches the next equilibrium point $\theta 3'$. It follows from this that if normal driving pulses are employed during either normal driving operation or a clockwise time correction and driving pulses with a pulse width shorter than normal are employed during a reverse counter-clockwise time correction, it is possible to construct a reversible stepping motor which does not require a mechanism to prevent reverse rotation.

Figure 12:
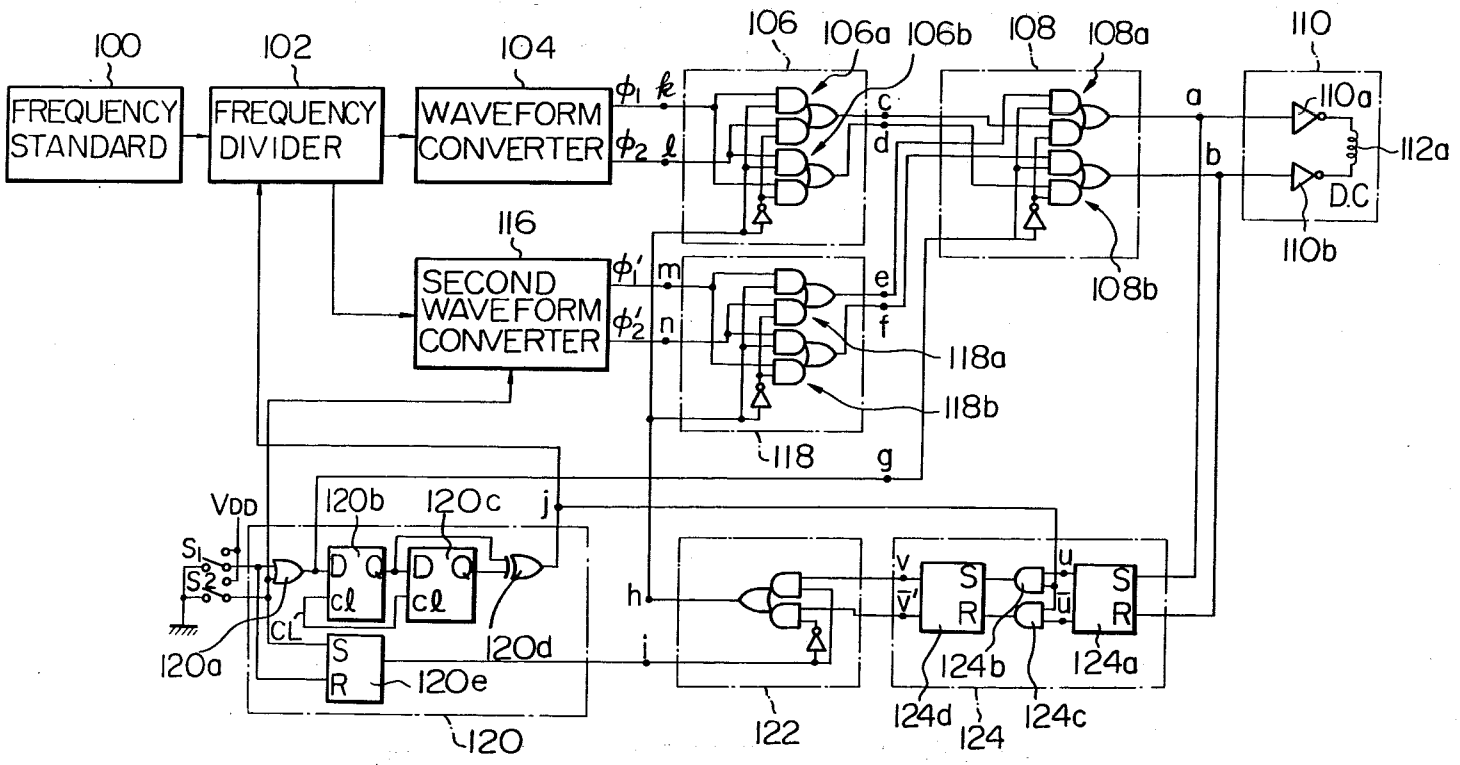
FIG. 12 is a partially detailed circuit arrangement for the timepiece shown in FIG. 8.

FIG. 12 shows a detail circuitry for the electronic timepiece shown in FIG. 8 which makes use of a reversible stepping motor such as described above. The first waveform converter 104 produces two-phase pulses $\phi 1$ and $\phi 2$ of the first pulse width $\tau_2$ at a first predetermined frequency for normal timekeeping mode. These pulses $\phi 1$ and $\phi 2$ appear as output signals at respective terminals k and l. The first selector circuit 106 includes first and second gate means **106*a* and 106*b* for normally passing the pulses $\phi 1$ and $\phi 2$ to respective terminals c and d. These gate means are operative to pass the pulses $\phi 1$ and $\phi 2$ in inverse order to the terminals c and d in response to the control signal from the control gate 122. The second waveform converter 116 normally produces at respective terminals m and n two-phase pulses $\phi 1'$ and $\phi 2'$ of the second pulse width $\tau_3$ greater than the normal driving pulse width and having a second predetermined frequency higher than the normal driving pulse in order to effect a high speed time correction. When the counter-clockwise correction switch $S_2$ is coupled to the positive terminal $V_{dd}$ of the battery, the second waveform counter 116 produces two-phase pulses $\phi 1''$ and $\phi 2''$ of the third pulse width $\tau_4$ smaller than that of the two-phase pulses $\phi 1$ and $\phi 2$. Preferably, the frequency of the pulses $\phi 1'$,$\phi 2'$,$\phi 1''$ and $\phi 2''$ is selected to be 32 Hz. The second selector circuit 118 comprises first and second gate means 118*a* and 118*b* which pass the pulses $\phi 2'$ and $\phi 1'$ to respective terminal e and f in the absense of the control signal and pass these pulses in inverse order to the respective terminal e and f in the presence of the control signal. The change-over circuit 108 includes first and second gate means 108*a* and 108*b* which perform a switching function between normal driving pulses $\phi 1$ and $\phi 2$ which are applied to the driver circuit 110 and high speed correction pulses $\phi 1'$ and $\phi 2'$. During normal operation, normal driving pulses $\phi 1$ and $\phi 2$ appear as output signals at respective terminals a and b and are fed to the driver circuit 110 whereby the reversible stepping motor 112** is rotated in a normal manner, i.e., in a clockwise direction.

For a clockwise time correction, clockwise correction switch $S_1$ is connected to the positive side $V_{dd}$ of the power supply, and an output terminal g of an OR gate **12*a* of the correction circuit 120 goes to a "1" logic level, changing over the state of the change-over circuit 108 and thereby making it possible for $\phi 1'$ and $\phi 2'$ to pass. At the same time, the output of the OR gate 120*a* is applied to a first data-type flip-flop 120*b* whose Q output is coupled to a second data-type flip-flop 120*c*. The outputs of the flip-flops 120*b*** and 120*c* are coupled to inputs of an exclusive OR gate **120*d*, which generates a reset pulse at output terminal j when the switch $S_1$ is depressed. The reset pulse at the output terminal j is delivered to the frequency divider 102, thereby resetting the frequency divider 102** to zero.

Figure 13:
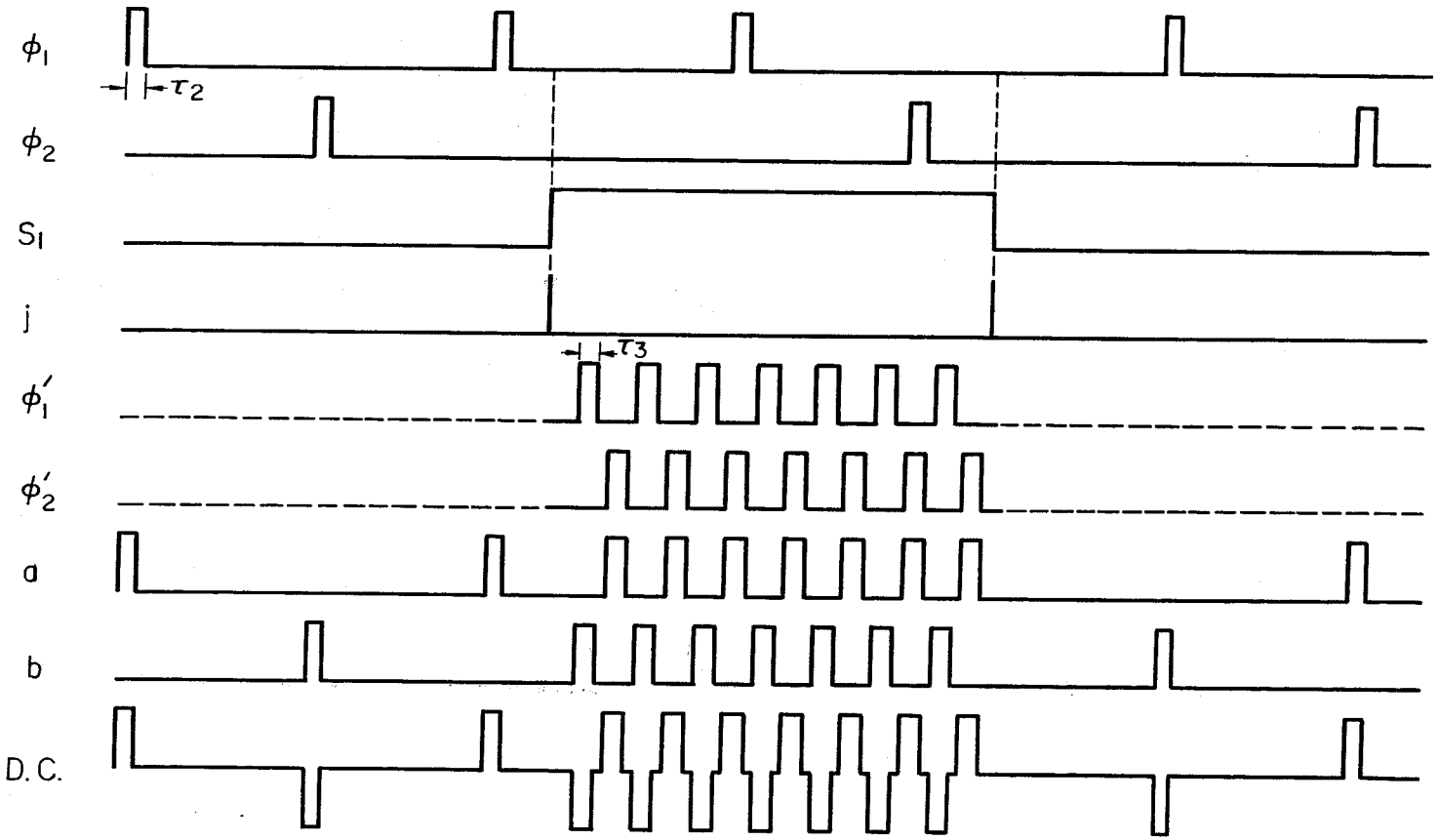
FIG. 13 is a timing chart for illustrating the operation of the timepiece shown in FIG. 12 in a case in which the stepping motor is driven clockwise.

If it is assumed that a final pulse has been applied to terminal a prior to the operation of the clockwise correction switch $S_1$, an R-S type flip-flop **124*a* of the pulse-phase memory circuit 124 is set and output terminals u and u attain respective "1", "0" logic levels which are passed by AND gates 124*b*, 124*c* due to the reset pulse generated by the exclusive OR gate 120*d*. Therefore an R-S type flip-flop 124*d* is set, and output terminals v and v' attain respective "1", "0" logic levels. Furthermore, since output terminal i of an R-S type flip-flop 120*e* of the correction circuit 120 is at a "0" logic level, an output terminal h of the control gate 122 follows the output of terminal v' and thus attains a "0" logic level. Accordingly, as seen in FIG. 13, pulses $\phi 1'$ and $\phi 2'$ having a pulse width $\tau_3$ appear at the respective output terminals f and e of the second selector circuit 118. These pulses are passed by the change-over circuit 108 such that pulses $\phi 1'$ appears at terminal b and pulse $\phi 2'$ at terminal a. Thus, the initial correction pulse appears at terminal b whereby the reversible stepping motor 112** begins to rotate in the clockwise direction at a speed which is faster than normal, thereby performing time correction.

If upon completion of the correction clockwise correction switch $S_1$ goes to "0" logic level a reset pulse appears at terminal i, resetting the frequency divider 102 to zero. In this case, pulse $\phi 1$ appears at terminal k of the first waveform converter 104 after one second and pulse $\phi 2$ appears at terminal l after two seconds. If it is assumed that the number of correction pulses is 14, terminal u attains a "1" logic level and terminal u a "0" logic level since the final correction pulse has been applied to terminal a. Thus, as was previously the case, the reset pulse brings v to a "1" logic level and v' to a "0" logic level. Terminal i remains as it is, namely "0", v' and thus h attain "0" logic levels, pulse $\phi 2$ appears at output terminal c of the first selector circuit 106 and pulse $\phi 1$ at terminal *d*. These are passed by the change-over circuit 108 such that pulse $\phi 1$ appears at output terminal b and pulse $\phi 2$ at output terminal a. Thus, one second after the switch $S_1$ is connected to grounded the reversible stepping motor 112 begins to rotate in the clockwise direction at normal speed to drive the time-indicating means 114 to display time.

For a reverse, counter-clockwise correction, reverse correction switch $S_2$ is connected to the positive side of the power supply, which raises OR-gate output terminal g of the correction circuit 120 to a "1" logic level changing over the state of the change-over circuit 108 and thereby making it possible for $\phi 1''$ and $\phi 2''$ to pass. A reset pulse is delivered to output terminal j of the exclusive OR-gate 120*d* thereby resetting to zero the frequency divider 102 which at this time begins the dividing operation.

Figure 14:
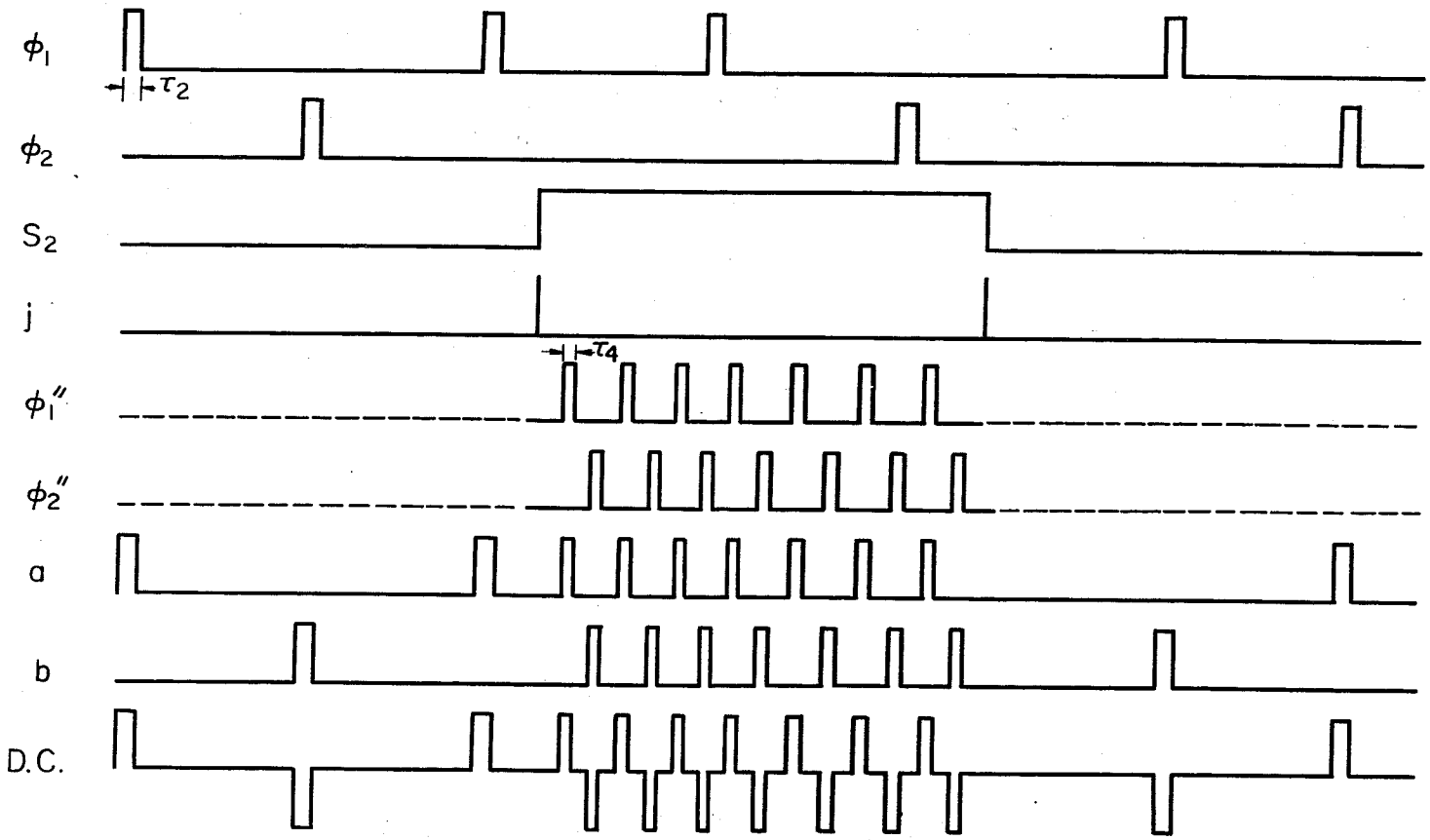
FIG. 14 is similar to FIG. 13 but shows a case in which the stepping motor is driven counter-clockwise.

If it is assumed that a final pulse has been applied to terminal a prior to the operation of the reverse correction switch $S_2$, the output terminals u, u of the pulse-phase memory circuit 124 attain respective "1", "0" logic levels which are passed by the AND gates 124*b*, 124*c* due to the reset pulse and memorized by the flip-flop 124*d* the output terminals v and v' of which attain respective "1", "0" logic levels. Furthermore, since the output terminal i of the flip-flop 120*e* of the correction circuit 120 attains a "1" logic level, the output terminal h of the control gate 122 follows the output of terminal v and thus attains a "1" logic level. Accordingly, as seen in FIG. 14, pulses $\phi 1''$ and $\phi 2''$ appear at respective output terminals e and f of the second selector circuit 118 and are passed by the change-over circuit 108 such that they appear at respective terminals a and b. Thus, although the initial correction pulse appears at terminal a, this pulse is in phase with the final pulse during the normal driving operation whereby the reversible stepping motor begins to rotate in the reverse direction at a speed which is faster than normal.

If upon completion of the correction reverse correction switch $S_2$ goes to "0" logic level, a reset pulse appears at terminal i, the frequency divider 102 is reset to zero, pulse $\phi 1$ appears at terminal k of the first waveform converter 104 after one second and pulse $\phi 2$ appears at terminal l after two seconds. If it is assumed that the number of correction pulses is 14, terminal u attains a "0" logic level and terminal u a "1" logic level since the final correction pulse has been applied to terminal b. Thus, the reset pulse brings v to a "0" logic, and v' to a "1" logic level. Terminal i remains as it is, namely "1", v and thus h attain "0" logic levels, pulse $\phi 2$ appears at output terminal c of the selector circuit 106 and pulse $\phi 1$ at terminal d. These are passed by the change-over circuit 108 such that pulse $\phi 1$ appears at output terminal b and pulse $\phi 2$ at output terminal a. One second after the completion of the correction a normal driving pulse in phase with the final correction pulse is applied and the stepping motor begins to turn in the clockwise direction and resume normal rotation. In order to return the motor from the reverse correction to normal rotation the best course to follow is applying the driving coil at the beginning with a normal driving pulse in phase with the final correction pulse. However, if it is possible to permit a situation in which the driving pulse is not followed then either pulse $\phi 1$ or $\phi 2$ may be applied without causing a reversal in rotation providing they have the same pulse width as normal driving pulse.

Figure 15:
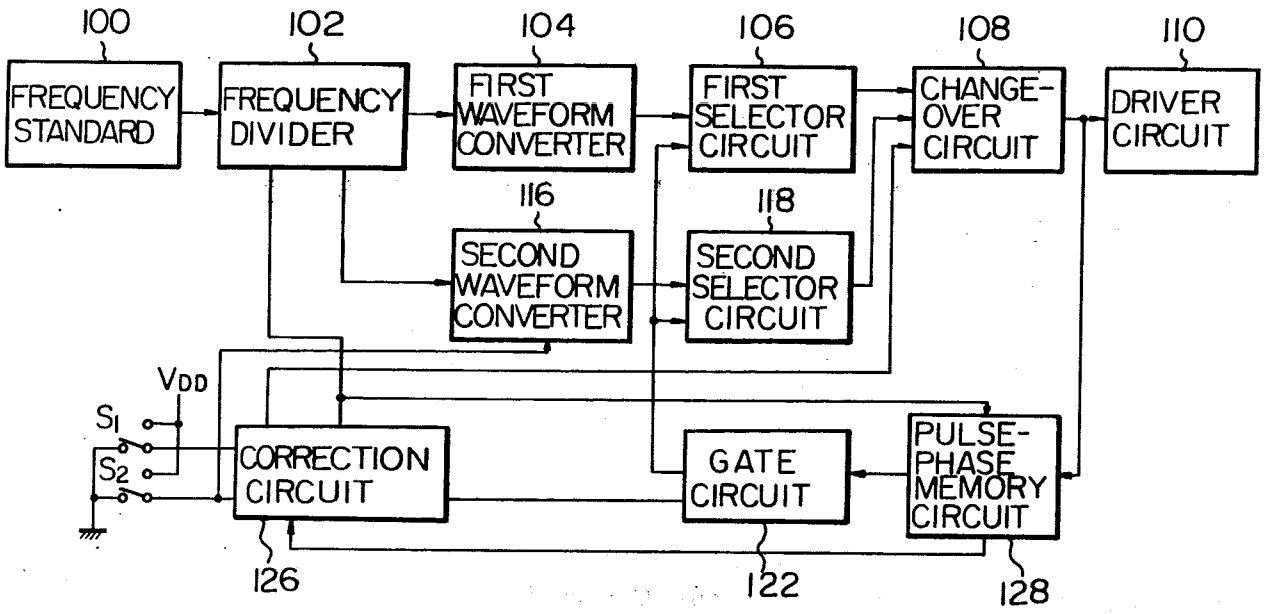
FIG. 15 is a block diagram of a modification of the timepiece shown in FIG. 8.
Figure 16:
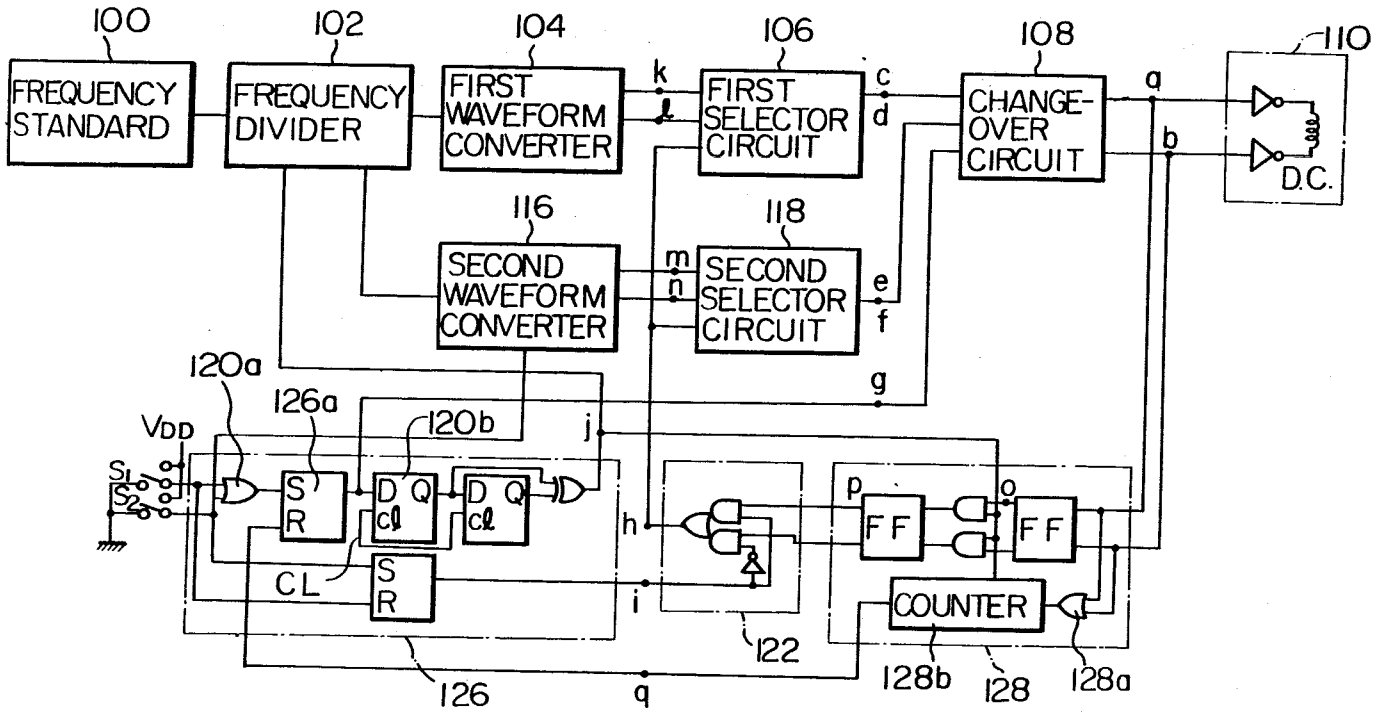
FIG. 16 is a partially detailed circuit arrangement for the timepiece shown in FIG. 15.

FIG. 15 shows a block diagram of a modification of the timepiece shown in FIG. 12 and FIG. 16 shows a partial detail circuitry for the timepiece shown in FIG. 15. The embodiment of FIG. 15 is adapted to permit the hands of a timepiece to be rapidly adjusted to correct for a time differential and also makes it possible for the hands to be set to any desired position. This is accomplished by using the output of counter circuit 128 to control correction starting circuit 126 which limits the number of correction pulses. Counting circuit 128 is the afore-mentioned pulse-phase memory circuit 124 with an additional OR gate 128*a* and counter 128*b*, correction starting circuit 126 is constructed by inserting RS-FF 126*a* between OR gate 126*a* and D-FF 120*b* of correction circuit 120, and the output terminal q of counter 128*b* is connected to the reset terminal of RS-FF 126*a*.

To correct for a time differential counter 128*b*, for an electronic timepiece having a seconds hand would be constructed of two series-connected divide-by-60 counters. If the number of correction pulses is regulated to 3600 a one hour time differential can be corrected for each time the clockwise correction switch or reverse correction switch is operated. Moreover, if counter 128*b* of counting circuit 128 is made to record the customary position of the hands in correspondence with the driving pulses and is made to operate as an adding or substracting counter during a clockwise correction or reverse correction, then the hands of the timepiece can be rapidly corrected to their desired positions.

Thus according to the features of this embodiment reverse rotation is made possible only by pulses having a pulse width narrower than the normal driving pulses which themselves do not induce reverse rotation. Accordingly, a mechanical mechanism to prevent reversal of the rotor is not necessary since a reversal will not occur even if there is a lack of agreement in the corresponding relationship between the phase of the driving pulse and the magnetic poles of the rotor following replacement of the battery. Although it is permissible to apply twice in a continuous manner pulses which are in phase (a normal driving pulse which is inphase with the final correction pulse during a reversal) in order to return from reverse rotation to clockwise rotation, the clockwise rotation will begin if the width of a correction pulse having a width narrower than that of the normal driving pulse is changed to the width of the normal driving pulse.

If correction pulses having a frequency higher than the normal driving pulses are applied to the driving coil by the clockwise correction switch when the hands of the timepiece are behind time and by the reverse correction switch when the hands are ahead of time, the hour hand, minute hand and seconds hand can be quickly adjusted. It is also possible to construct a wristwatch which does not require a crown. Furthermore, an electronic timepiece can be designed in which time differentials can be corrected by advancing or turning back the hands a prescribed amount of time each time the clockwise or reverse correction switches are operated. This is accomplished by making use of the counting circuit to count and control the number of correction pulses applied to the driving coil. Moreover, if the positions of the hour, minute and seconds hands are stored in the counting circuit and correction pulses which are equivalent in number to the numerical value indicated by counting circuit during a correction are applied to the driving coil, the hands of the timepiece can be instantly corrected and set to a prescribed position.

While the present invention has been shown and described with reference to particular embodiments by way of example, it should be noted that various other changes or modifications may be made without departing from the scope of the present invention. For example, although the external control members have been shown as being normally connected to the negative side of the battery, it should be understood that the external control members may be normally connected to the positive side of the battery and, in this case, an inverter may be coupled to an output of the switches. It should also be noted that the grounded side of the battery may be used as a high potential side, if desired.

What is claimed is:

1. An electronic timepiece comprising:

a frequency standard providing a relatively high frequency signal;

a frequency divider providing first and second low frequency signals in response to said relatively high frequency signal;

first and second external control members adapted to be actuated during clockwise and counter-clockwise correction modes, respectively;

means for normally providing alternating current pulses of a first pulse width at a first predetermined frequency in response to said first low frequency signal and operative to provide second and third alternating current pulses of second and third pulse widths in response to said second low frequency signal when said external control members are actuated during said clockwise and counter-clockwise correction modes, respectively; and a reversible stepping motor operatively connected to time-indicating hands of the timepiece, said reversible stepping motor being rotatable in a clockwise direction in response to said first and second alternating current pulses at first and second speeds, respectively, and also rotatable in a counter-clockwise direction in response to said third alternating current pulses.

2. An electronic timepiece equipped with a stepping motor having a rotor to drive a time-indicating mechanism to provide time display, comprising:

a frequency standard producing a relatively high frequency signal;

a frequency divider dividing down the relatively high frequency signal to produce first and second low frequency signals;

a waveform converter producing first output pulses of a first pulse width at a first frequency in response to said first low frequency signal and second output pulses of a second pulse width in response to said second low frequency signal, with the second pulse width being greater than said first pulse width and having a second frequency higher than said first frequency;

a manually operable external control member adapted to be actuated during time correction;

a control circuit connected to said waveform converter and including first gate means normally opened for normally passing the first output pulses therethrough, and second gate means adapted to be opened to pass the second output pulses therethrough when said external control member is actuated during said time correction; and a driver circuit connected to an output of said control circuit for normally generating first alternating driving current pulses of said first pulse width and at said first frequency in response to said first output pulses so as to drive the stepping motor to advance said time-indicating mechanism at a normal speed, and producing second alternating driving current pulses of said second pulse width greater than said first pulse width and at said second frequency so as to drive the stepping motor to advance said time-indicating mechanism at a higher than normal speed, said stepping motor being responsive to said second alternating current pulses and applied with electric current higher than that applied in response to said first alternating current pulses, thereby preventing inaccurate advancement of said rotor during said time correction.

3. An electronic timepiece having a battery and a stepping motor to drive a time-indicating mechanism to provide time display, comprising:

a frequency standard providing a relatively high frequency signal;

a frequency divider dividing down the relatively high frequency signal to produce first and second low frequency signals;

a waveform converter providing first and second output pulses of the same pulse width in response to said first and second low frequency signals, respectively;

a manually operable external control member adapted to be actuated during time correction;

a control circuit connected to said waveform converter for normally passing said first output pulses therethrough, said control circuit being connected to said external control member and operative to pass said second output pulses therethrough when said external control member is actuated;

a driver circuit connected to said control circuit for generating first and second alternating current pulses in response to said first and second output pulses for thereby driving said stepping motor;

a switching circuit connected to said external control member for normally coupling said driver circuit to said battery; and a level shifter connected to said frequency divider to generate an increased voltage which is applied to said driver circuit through said switching circuit when said external control member is actuated during said time correction, whereby said driver circuit generates said second alternating current pulses having an amplitude higher than that of said first alternating current pulses to increase driving current applied to said stepping motor during said time correction.

4. An electronic timepiece according to claim 3, in which said switching circuit comprises a first metal oxide semiconductor field effect transistor connected between said battery and said driver circuit for providing electrical connection therebetween when said external control member is actuated, and a second semiconductor field effect transistor connected between said driver circuit and said level shifter for providing electrical connection therebetween when said external control member is actuated.

5. An electronic timepiece comprising:

a frequency standard providing a relatively high frequency signal;

a frequency divider providing first and second predetermined low frequency signals in response to said relatively high frequency signal;

a first waveform converter providing first two-phase output pulses of a first pulse width in response to said first low frequency signal;

a second waveform converter providing second two-phase output pulses of a second pulse width in response to said second low frequency signal;

first and second external control members adapted to be actuated during clockwise correction and counter-clockwise corrections, respectively;

a correction circuit coupled to said first and second external control members and including means for generating first and second outputs when said first and second external control members are actuated, respectively;

a control circuit including a first selector circuit normally passing said first two-phase output pulses therethrough, a second selector circuit normally passing said second two-phase output pulses therethrough, and a change-over circuit normally passing said first two-phase output pulses therethrough, said change-over circuit being responsive to said first output from said correction circuit and operative to pass said second two-phase output pulses therethrough;

means for storing the phase of a final pulse appearing at output terminals of said change-over circuit and generating first and second outputs in dependence thereon;

a gate circuit generating a first control signal in the absence of said second output of said correction circuit and said first output of said storing means and generating a second control signal in the presence of said second output of said correction circuit and said second output of said storing means, said second selector circuit being operative to pass said second two-phase output pulses in first and second phase relationships in response to said first and second control signals, respectively;

a driver circuit connected to said output terminals of said change-over circuit for generating first alternating current pulses in response to said first two-phase output pulses during a normal operation, said driver circuit also generating second and third alternating current pulses in dependence on the phases of said second output pulses appearing at said output terminals of said change-over circuit during said clockwise and counter-clockwise corrections, respectively; and a reversible stepping motor including a permanent magnet rotor to actuate time-indicating hands of the timepiece, stators and a driving coil connected to said driver circuit, in which the angle of static equilibrium defined by the magnetic poles of the stators and the magnetic poles of the rotor is an angle with a magnitude between 20 and 40 degrees.

6. An electronic timepiece according to claim 5, in which said third alternating current pulses have a pulse width narrower than that of said first alternating current pulses.

7. An electronic timepiece according to claim 5, in which said second alternating current pulses have a pulse width greater than that of said first alternating current pulses.

8. An electronic timepiece according to claim 5, in which said correction circuit includes a flip-flop adapted to provide said first output when either one of said first and second external control members is actuated during said time corrections, and further comprising counter circuit means connected to said output terminals of said change-over circuit and generating an output signal when the count reaches a predetermined value, said output signal being applied to a reset terminal of said flip-flop which is consequently reset to stop the supply of said first output to said change-over circuit thereby to limit the number of said second two-phase output pulses applied to said driver circuit whereby said time-indicating hands are set to a predetermined position.

* * * * *